United States Patent [19]

Hazard

[11] 4,047,643

[45] Sept. 13, 1977

[54] SAFETY DISPENSING CLOSURE WITH MOVABLE RETAINER

[75] Inventor: Robert E. Hazard, North Kingstown, R.I.

[73] Assignee: Polytop Corporation, Slatersville, R.I.

[21] Appl. No.: 235,970

[22] Filed: Mar. 20, 1972

[51] Int. Cl.[2] ..... B65D 55/02

[52] U.S. Cl. ..... 222/153; 222/534; 222/536

[58] Field of Search ..... 222/153, 402.11, 534, 222/536

[56] References Cited

U.S. PATENT DOCUMENTS

| | | | |
|---|---|---|---|
| 1,537,399 | 5/1925 | Wiswell | 222/536 |
| 2,706,660 | 4/1955 | Johnson et al. | 222/402.11X |
| 2,715,481 | 8/1955 | McGhie et al. | 222/402.11 X |
| 3,249,260 | 5/1966 | Goldberg | 222/182 |
| 3,306,499 | 2/1967 | Lykes | 222/536 X |
| 3,426,948 | 2/1969 | Stirling | 222/402.11 |

*Primary Examiner*—Robert B. Reeves
*Assistant Examiner*—Frederick R. Handren
*Attorney, Agent, or Firm*—Edward D. O'Brian

[57] ABSTRACT

A safety-type dispensing closure can be constructed using a spout rotatably mounted on a closure body so that it is capable of being rotated between open and closed positions and using a retainer movably mounted on the retainer body. The retainer used in such a closure is capable of being moved to a position in which it does not interfere with spout rotation between the two positions specified and to other positions in which it blocks such movement. The retainer used is preferably a ring rotatably mounted on the closure body so as to be conveniently accessible and so as to appear as a part of the body.

13 Claims, 6 Drawing Figures

INVENTOR
ROBERT E. HAZARD
BY
EDWARD D. O'BRIAN
ATTORNEY

SAFETY DISPENSING CLOSURE WITH MOVABLE RETAINER

CROSS-REFERENCE TO RELATED APPLICATIONS

This application contains subject matter disclosed and claimed in the abandoned application Ser. No. 139,559 filed May 3, 1971 by Robert E. Hazard entitled "Safety Dispensing Closure with Movable Retainer".

BACKGROUND OF THE INVENTION

The present invention pertains to what may be referred to as "safety closures". Closures which are relatively difficult to open so that they are not apt to be opened by comparatively young children or by persons of less than normal mental capacity are commonly referred to as "safety closures." To be acceptable commercially such closures must meet a number of qualifications. Such closures to be acceptable must not be so difficult to open that they cannot be easily opened by relatively aged infirmed persons, and yet they must be sufficiently difficult to open so that the young children or the mentally deficient find it difficult if not imposible to open them. Further, to be commercially acceptable these closures must be inexpensively produced and assembled. Also, to meet the demands of industry they have to be aesthetically desirable in appearance.

A large number of efforts have been made at providing various different closures which will meet these various qualifications. Meeting these qualifications has been a particular problem in the field of dispensing closures--that is, closures utilizing a closure body and a spout or spout-like member mounted on the closure body so as to be capable of being moved between a closed position in which the opening of the closure body is closed by the spout and an open position in which the spout is in communication with the opening. Closures of this type are constructed as shown by the Wilson et al U.S. Pat. No. 2,793,795, the Mart U.S. Pat. 2,282,895, the Libit et al U.S. Pat. Nos. 3,111,245 and 3,502,248.

SUMMARY OF THE INVENTION

A broad objective of the present invention is to provide new and improvided safety or safety-type closures. A more specific objective of the present invention is to provide closures of this type which operate significantly different from prior related structures. More specifically it is an objective of the present invention to provide closures which can only be opened as the result of two different distinct, separate, sequential motions, each of which may be easily carried out so easily that these closures can be opened by a relatively aged or infirmed person.

Further objectives of the present invention are to provide a safety-type closure employing parts which can be easily and conveniently manufactured at nominal costs using present-day techniques, which may be assembled without significant difficulty, which utilize constructional features as have previously been established to provide for satisfactory opening and closing actions and for satisfactory sealing, and which have an acceptable aesthetically desirable appearance. This latter is quite important.

In accordance with this invention these and various related objectives of it are achieved by providing in a closure having a closure body and having a closure part such as a spout movably mounted on the closure body so as to be capable of being moved between a closed position in which an opening in the body is closed off and an open position in which the opening is uncovered the improvement which comprises: a retainer means movably mounted on the closure body so as to be capable of being moved with respect to the closure body relative to said closure part, said closure part being capable of being moved between said open and closed positions when said retainer is in one position relative to said spout, said closure part being capable of being held in said closed position by said retainer when said retainer is in other than said one positon.

BRIEF DESCRIPTION OF THE DRAWINGS

Inherently a brief summary of this type is incapable of completely indicating the nature of a suitable structure in accordance with the invention. Such a structure is best indicated with reference to the accompanying drawings in which.

Figure 1:
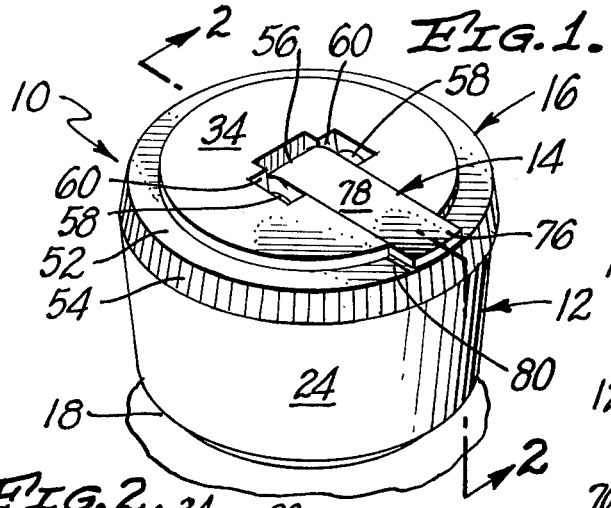
FIG. 1 is an isometric view of a presently preferred embodiment or form of a safety closure in accordance with this invention installed on a container neck.
Figure 4:
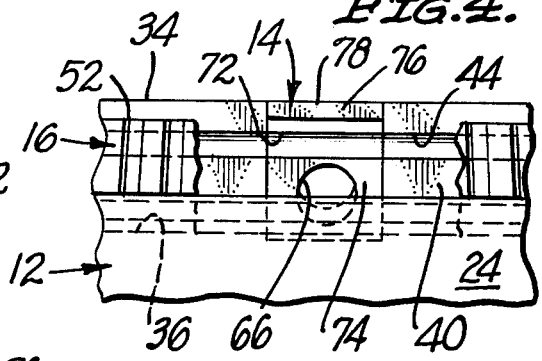
FIG. 4 is a partial elevational view of the closure shown in the preceding figures, a portion of the retainer shown in this view being broken away.

Upon a consideration of the drawings it will be realized that the closure shown in the drawings is not the invention, but instead is a specific structure embodying the intangible concepts of the invention as delineated in the appended claims forming a part of this disclosure. It will be apparent to those skilled in the art of dispensing closures that these concepts may be embodied or used in dispensing closures which are somewhat differently constructed than the specific dispensing closure shown through the use or exercise of routine engineering skill. It will be apparent to such individuals that the essential features of the present invention can also be embodied in closures in a somewhat different manner than illustrated through the use or exercise of routine engineering skill.

DETAILED DESCRIPTION OF THE PREFERRED EMBODIMENT

In the drawings there is shown a safety dispensing closure 10 constructed in accordance with the present invention. This closure 10 includes a closure body 12, a rotatable spout 14 and a rotatable retainer ring 16. These parts are preferably formed by conventional injection molding techiques out of a material such as a polyolefin having some resiliency and elasticity and capable of undergoing temporary deformation under applied force. The entire closure 10 is adapted to be mounted upon a cylindrical container neck 18 in such a manner that it cannot be readily removed from this neck 18 as by the actions of a customer. If convenient, however, the closure 10 may be formed integrally with an appropriate container.

In the structure shown undesired removal of the closure 10 from the neck 18 is prevented by forming around the periphery of this neck 18 a sloping conically shaped lead-in wall 20 which extends to another similarly shaped wall 22 serving essentially as a latch surface. With this structure an external cylindrical skirt 24 forming a part of the closure body 12 may be forced down upon the neck 18 as the closure 10 is assembled upon this neck 18. As this occurs an internal conical surface 26 on the skirt 24 will abut against the wall 20 so as to cause a limited amount of temporary deformation in the skirt 24.

At such time as the surface 26 passes beyond the wall 20, the skirt 24 will assume or tend to assume its initial configuration so that a small latching surface 28 within the skirt 24 immediately above the surface 26 fits against the wall 22, making it substantially impossible to withdraw the closure 10 from the container neck 18 during normal utilization of the closure 10. With this structure in essence the walls 20 and 22 and the surfaces 26 and 28 define what may be regarded as cooperating latch or holding structures for latching and holding the closure 10 upon the neck 18 against inadvertent or accidential removal, making it relatively difficult to get the closure 10 off of the neck 18.

When the closure 10 is assembled as indicated in the preceding, an internal cylindrical plug 30 dependent from the body 12 within the skirt 24 is moved downwardly into engagement with the interior of the neck 18. When the plug 30 is in position external annular ridges 32 engages the interior of this neck 18 so as to form a seal with respect to the neck 18. This structure may be referred to as a plug seal; it is obviously a sealing means. Those skilled in the art will recognize that a wide variety of other somewhat different sealing means may be utilized with the closure 10. The particular plug 30 shown may, if properly fitted with respect to the container neck 18, fit so tightly within this neck 18 as to serve as the latching and holding means indicated in the preceding discussion.

The closure body 12 is preferably, but not necessarily provided with a flat top 34. Such a flat top 34 is extremely desirable because of its appearance and because of the fact that it permits containers utilizing the closures 10 to be stacked one upon another. Around the periphery of this flat top 34 generally between it and the skirt 24 there is located a continuous ring-like groove 36. This groove 36 has outer and inner generally parallel walls 38 and 40. The wall 38 is significantly shorter than the wall 40 and is provided with an internal inwardly extending curved, continuous bead 42. The wall 40 is provided with a continuous groove 44 having the same general cross-sectional configuration as the bead 42 and located above the bead 42 in the general proximity of the flat top 34.

The groove 36 is intended to be used as a guide or guide means in holding the retainer ring 16 so that this ring 16 is rotatably supported on the closure body 12 around the periphery of the flat top 34 and the top of the skirt 24 and so that this ring 16 cannot be removed from the closure 10 during the normal utilization of this closure. It will be noted that the cross-sectional configuration of the ring 16 closely approximates that of the groove 36. Thus, this ring 16 includes an internal groove 46 which fits over the bead 42 and a bead 48 which fits within the groove 44. An important feature of the invention lies in the fact that the bead 48 is discontinuous in the sense that it is provided with a gap 50.

With the structure shown the ring 16 can be mounted or positioned on the closure body 12 by locating it about its intended position and applying force to it. Such force will cause temporary material deformation as the ring 16 is snapped into place. When the ring 16 is in position it is apparent that it is provided with a generally flat top 52 and a knurled or ribbed peripheral wall 54 appearing more or less as sort of a ridge-like extension of the skirt 24. In the structure shown, the flat top 52 is spaced a short distance below the flat top 34 and to a degree sets off the appearance of the ring 16.

In the closure 10 the spout 14 is rotatably mounted on the closure body 12 in a conventional manner so as to be incapable of being removed from the closure 10 during normal utilization of this closure. In the precise closure 10 shown such mounting is accomplished by providing on a cylindrical center member 56 forming a part of the spout 14 axially aligned shafts or trunnions 58 which hold the spout 14 in place as the result of being snapped through restricted entrances 60 of smaller widths than the trunnions 58 into bearing openings 62. This type of structure is more fully described in the Wilson et al U.S. pat No. 2,793,795.

Figure 2:
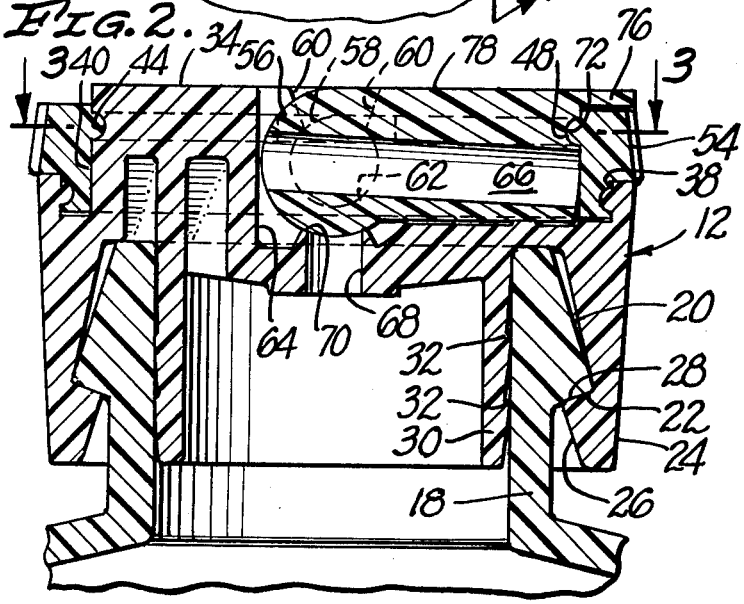
FIG. 2 is a cross-sectional view taken at line 2—2 of FIG. 1.

When the spout 14 is so held by the bearing openings 62 this spout 14 may be rotated to a closed position as shown in FIGS. 1 and 2 of the drawings so as to extend in an elongated cavity 64 in the closure body 12 in the flat top 34. For the spout 14 to be rotated to such a closed position the retainer ring 16 must be rotated to such a point that the gap 50 in the bead 48 is in alignment with this cavity 64. In this closed position a passage 66 extending through the spout 14 extends nearly transverse to an opening 68 leading through the closure body 12 to the bottom of the cavity 64. Preferably a known sealing ring 70 is formed on the closure body 12 around the opening 68 within the cavity 64 so as to resiliently engage the cylindrical center member 56 in order to form a seal therewith at all times.

In the closure 10 the spout 14 will be locked or retained in the closed position illustrated by rotating the retaining ring 16 so that the bead 48 slides into a groove 72 in the discharge end 74 of the spout 14. When the ring 16 is turned in this manner the spout 14 is effectively held within the cavity 64 so that it cannot be inadvertently moved to a vertical open position in which the passage 66 is in alignment with the opening 68. When it is desired to move the spout 14 to such an open position the retainer ring 16 may be rotated so that the gap 50 is directly opposite the end 74. In this position, the ring 16 presents no handicap to the rotation of the spout 14 to a vertical position.

To facilitate such rotation it is preferred to locate upon the ends 74 of the spout 14 a small, flat tab-like extension or handle 76. This handle 76 extends across the flat top 34 of the retainer ring 16 to adjacent to the wall 54. It will be noted that in the closure 10 the handle 76 appears much like an extension of a flat upper surface 78 of the spout 14. It will be noted that this surface 78 is flush with the flat top 34.

Figure 5:
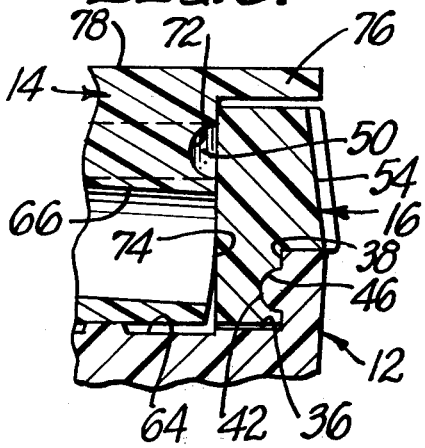
FIG. 5 is an enlarged detail view corresponding to a portion of FIG. 2 illustrating the relative positions of certain parts when the spout in the closure is capable of being moved between open and closed positions.
Figure 3:
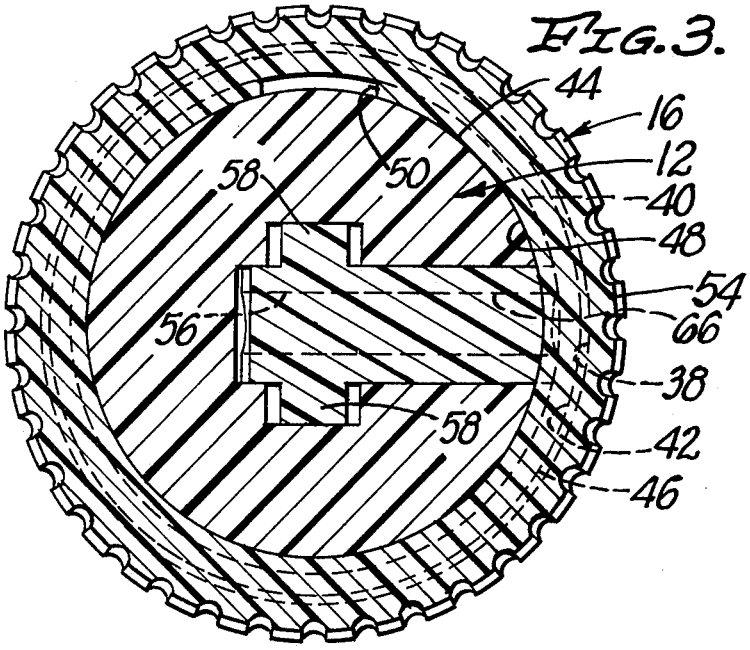
FIG. 3 is a cross-sectional view taken at line 3—3 of FIG. 2.

It is believed that it will be apparent from a careful consideration of the preceding that the precise closure 10 shown and described fulfills or meets various objectives of the invention as indicated in preceding portions of this specification. When the complete closure 10 is assembled even the comparatively aged or infirm person will have no difficulty in opening this closure by two distinct, separate, sequential motions. The first of these is rotation of the ring 16 to a position in which the gap 50 is opposite the spout 14 as indicated in FIG. 5 of the drawings.

If desired, markings 80 or other similar or related indicia may be formed or printed on the ring 16 and the closure body 12 so as to indicate when the ring 16 is in a position such that the spout 14 may be opened. In lieu of such indicia the wall 54 may be recessed slightly directly opposite the gap 50 so as to facilitate placing the ring 16 in such a position that because of a lack of interengagement between the ring 16 and the spout 14 that the spout 14 can be rotated to a vertically extending open position. Such movement of the spout 14 to an open vertical position involves a completely separate motion from the motion necessary to position the ring 16 as described.

Because of the two types of motions involved here it is thought that the closure 10 will be relatively difficult for comparatively young children or for those of less than normal capacity to open. Once the spout 14 has been opened the spout 14 can, of course, be returned to a closed position within the cavity 64. Then the ring 16 may be moved or turned so as to retain this spout 14 in the closed position as a consequence of engagement between the bead 48 and the groove 72.

Figure 6:
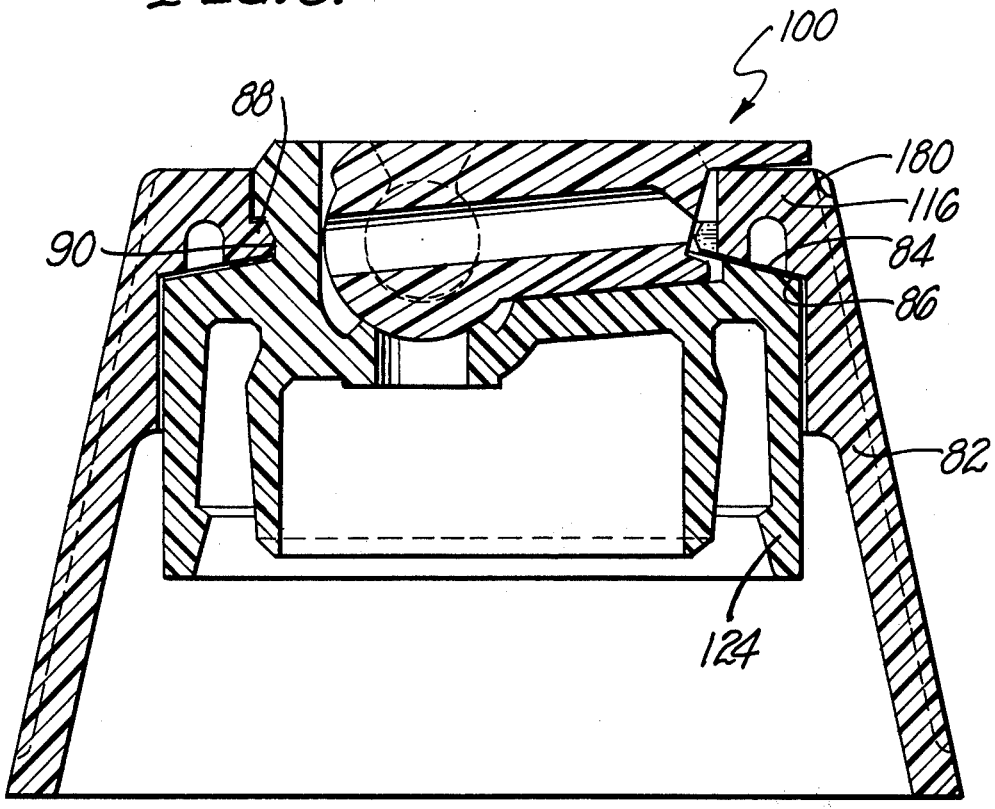
FIG. 6 is a view corresponding to FIG. 2 of a modified safety closure in accordance with this invention.

In FIG. 6 of the drawings there is shown a modified dispensing closure 100 constructed in accordance with the concepts of the present invention. Practically all parts of this closure 100 are the same or substantially the same as corresponding parts of the previously described closure 10. In the interest of brevity those parts of the closure 100 which are the same or nearly the same as corresponding parts of the closure 10 are not separately described herein and where necessary for explanatroy purposes are designated in the remainder of this specification and in the accompanying drawings by the numbers previously utilized to indicate such parts by the numeral 1.

In the closure 100 the rotatable retainer ring 116 is extended so as to include a dependent flaired skirt 82 which extends outwardly from this ring 116 in a downward direction so as to enclose and completely cover the skirt 124 utilized. Preferably this flaired skirt 82 extends downwardly far enough so as to completely block the view of a container neck. This skirt 82 may be referred to as a skirt-like cover because of its function as herein indicated. If desired, the skirt 124 may be formed so as to include a smooth annular top shoulder 84 which is adapted to rotatably support a corresponding annular recess 86 in the interior of the skirt 82 so that there is no danger of pressure being applied to the skirt 82 in such a way as to tend to pop or snap the ring 116 out of position.

The operation of the closure 100 is essentially the same as the operation of the previously described closure 10 and it has the advantages of the previously described closure 10. This closure 100 is shown so as to emphasize that various changes and/or additions may be made in the closure 10 without departing from the essential characters or features of this closure. Thus, for example, closures falling within the scope of this invention can be formed so as to include a snap acting bump detent structure 88 and cavity 90 as shown in FIG. 6 which are designed to serve as an indicating means to provide a physical indication by "feel" when the skirt 82 is turned that the skirt 82 is in a position where the closure 100 can be opened. A small marking such as the marking 180 in FIG. 6 on the ring 116 may be positioned relative to any other portion of the closure or another marking (not shown) on the closure so as to give a visual indication that the closure is in a position to be opened.

I claim:

1. A closure having a closure body and a closure part movably mounted on said closure body so as to be capable of being moved between a closed position in which an opening in said closure body is closed off by said closure said opening, said closure part being mounted on said closure body so as to be incapable of being removed from said closure body during movement between said open and closed positions, said closure body being adapted to be secured to a container, in which the improvement comprises:

a retainer means for holding said closure part against movement, said retainer means being mounted on said closure body so as to be incapable of being separated from said closure body during normal utilization of said dispensing closure and so as to be capable of being moved with respect to said closure body and relative to said closure part, said retainer means being accessible from the exterior of said closure so as to be capable of digital engagement so that it can be moved with respect to said closure body and relative to said closure part, said retainer means being a separate element from said closure body and said closure part and being capable of movement independently of said closure body and said closure part, said body includes holding means for holding said closure body with respect to a container so that it is incapable of being removed from such a container during normal utilization of said closure, said closure part is a spout, said spout being rotatably mounted on said closure body so that in said closed position said opening is covered by said spout and so that in said open position a passage within said spout is in alignment with said opening, said body including an annular groove, said retainer means comprises a ring fitting within said groove so as to be capable of being turned in said groove, said ring and said spout being formed so that in one position of said ring relative to said spout said spout is capable of being moved between said open and said closed positions, said ring and said spout being formed so that in all other positions of said ring relative to said spout and said closure body said spout is physically blocked by said ring so as to be incapable of being rotated from said closed position to said open position.

2. A closure as claimed in claim 1 including:

means for indicating when said ring is in said one position in which said spout is capable of being moved so as to open said closure.

3. A closure as claimed in claim 2 wherein:

said means for indicating comprise indicia formed on said ring indicating with respect to the remainder of said closure when said ring is in said one position.

4. A closure as claimed in claim 2 wherein:

said means for indicating comprise detect means for providing an indication which may be felt during hard movement of said ring for indicating when said ring is in said one position in which said spout is capable of being moved so as to open said closure.

5. A closure as claimed in claim 1 wherein:

said closure body has a top and said annular groove is located within said top.

6. A closure as claimed in claim 1 wherein:

said closure body has a top and a peripheral skirt, said ring is mounted on said closure body and includes an attached skirt-like cover extending around and covering said skirt.

7. A dispensing closure having a closure body including a generally circular top and a skirt attached to the periphery of said top so as to extend therefrom, said skirt including means located thereon for attaching said skirt to a container for holding said closure top with respect to a container so that it is incapable of being removed from such a container during normal utilization of said closure, said dispensing closure also including a spout rotatably mounted on said top so as to be incapable of being separated from said closure body during normal utilization of said closure and so as to be capable of being moved with respect to said closure body between open and closed positions, in said open position a passage within said spout being in communication with an opening in said top of said closure body, in said closed position said spout engaging said closure body adjacent to said opening so as to seal off said opening in which the improvement comprises:

a groove formed in said closure body, a retainer means for holding said spout against movement mounted within said groove, said retainer means being capable of movement within said groove, being accessible to the exterior of said closure during the utilization of said closure and being incapable of being separated from said closure body during the normal utilization of said dispensing closure, said retainer means having a plurality of positions within said groove, in one position of said retainer means within said groove said retainer member being spaced from said spout so that said spout can be moved between said open and closed positions, said retainer means in all other positions serving to physically engage said spout when said spout is in said closed position so as to block the movement of said spout from said closed position to said open position by physical engagement with said spout, said goove is an annular groove extending around said opening in said closure body, said retainer means is a ring located within said groove, said ring having a notch formed therein, said spout has a lip formed thereon which extends beneath a portion of said ring when said spout is in said closed position, said lip being capable of passing through said notch when said ring is located so that said notch is adjacent to said spout, said one position being the position of said ring in which said notch is adjacent to said spout, said ring serving to block movement of said spout from said closed to said open position by said lip physically engaging said ring when said ring is in other than said one position.

8. a dispensing closure as claimed in claim 7 wherein:

said groove and said ring are mounted on said top so as to extend around the periphery of said top.

9. A dispensing closure as claimed in claim 8 wherein:

said ring includes an attached skirt-like cover extending around and covering said skirt of said closure body.

10. In a dispensing closure of the class which comprises a base having means to attach the closure to the opening of a container, a spout having a knuckle rotatably held in a cavity in the base, the spout being adapted to be actuated from a closed to an open position for flow of contents from the container and vice versa to interrupt flow, the base having an axis substantially aligned with the axis of the container opening, the spout, in its closed position, being substantially normal to said axis, the improvement which comprises: an annular member carried on the top of the base, means to retain said member in rotatable relation with the base, said member having a recess on the inside thereof, said recess being so configured and positioned with respect to the free end of the spout that, when the member is rotated to bring the recess and end of the spout into register, the spout may be rotated to its open position through said recess and, when the spout is closed and the member has been rotated out of register, movement of the spout to the open position is prevented.

11. The combination in accordance with claim 10 further characterized by the provision of protuberances on the member to facilitate rotation thereof.

12. A closure having a closure body including means for holding said closure body with respect to a container so that it is incapable of being removed from a container during the normal utilization of said closure and having an opening extending therethrough, said closure also having a spout rotatably mounted on said closure body so as to be capable of being rotated between a closed position in which said opening in said closure body is closed off by said spout and an open position in which a passage within said spout is in alignment with said opening, said spout extending from said closure body when in said open position and extending adjacent to said closure body when when in said closed position, said spout being mounted on said closure body so as to be incapable of being removed from said closure body during movement between said open and said closed positions during normal utilization of said closure, in which the improvement comprises:

a retainer for engaging said spout so as to hold said spout against rotation when said spout is in said closed position, cooperating means on said retainer and said closure body for movably mounting said retainer on said closure body so that said retainer is incapable of being separated from said closure body during the normal utilization of said closure and so that said retainer is capable of being moved with respect to said spout and said closure body between locked and unlocked positions, in said locked position said retainer being located so as to physically prevent movement of said spout from said closed position and in said unlocked position said retainer being located so as to be spaced relative to said spout so as to permit said spout to be rotated between said opened and closed positions, said retainer being accessible from the exterior of said closure so as to be capable of digital engagement so that it can be moved with respect to said closure body and said spout.

13. A closure as claimed in claim 12 in which:

said retainer is a ring rotatably mounted on said closure body so as to be capable of being rotated between a locked position in which said ring physically prevents movement of said spout from said closed position and an unlocked position in which a portion of said ring is located relative to said spout so that said spout can be rotated between open and closed positions.

* * * * *

UNITED STATES PATENT OFFICE
CERTIFICATE OF CORRECTION

PATENT NO. : 4,047,643
DATED : September 13, 1977
INVENTOR(S) : ROBERT E. HAZARD It is certified that error appears in the above-identified patent and that said Letters Patent are hereby corrected as shown below:

Column 2, line 13, change "positon" to --position--.

Column 3, line 31, change "engages" to --engage--.

Column 5, line 33, change "explanatroy" to --explanatory--.

Column 6, line 9, between the words "closure" and "said opening" insert the clause --part and an open position in which material can pass through--.

Column 6, line 63, change "detect" to --detent--.

Column 7, line 59, capitalize "a".

Column 8, line 32, delete one "when".

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*